US006073972A

United States Patent [19]

Rivera

[11] Patent Number: 6,073,972

[45] Date of Patent: Jun. 13, 2000

[54] COMPOSITE BODY FAUCET CONNECTION

[75] Inventor: Samuel T. Rivera, Saugus, Calif.

[73] Assignee: Emhart Inc., Newark, Del.

[21] Appl. No.: 09/080,921

[22] Filed: May 19, 1998

[51] Int. Cl.[7] ..... F16L 3/00

[52] U.S. Cl. ..... 285/64; 285/82; 285/321; 285/360; 137/801

[58] Field of Search ..... 285/64, 82, 81, 285/321, 360, 361, 376, 396, 401, 402; 137/801

[56] References Cited

U.S. PATENT DOCUMENTS

| | | |
|---|---|---|
| 795,069 | 7/1905 | Settlage . |
| 1,490,771 | 4/1924 | Fortin et al. . |
| 4,262,699 | 4/1981 | Fabian . |
| 4,477,109 | 10/1984 | Kleuver . |
| 4,516,753 | 5/1985 | Thomsen . |
| 4,667,987 | 5/1987 | Knebel . |
| 5,143,346 | 9/1992 | Chen . |
| 5,213,377 | 5/1993 | Humpert et al. . |
| 5,259,650 | 11/1993 | Gnauert et al. . |
| 5,558,128 | 9/1996 | Pawelzik et al. . |
| 5,630,628 | 5/1997 | Mönch . |
| 5,685,341 | 11/1997 | Chrysler et al. . |

*Primary Examiner*—Dave W. Arola
*Attorney, Agent, or Firm*—Harold Weinstein

[57] ABSTRACT

A composite body 20 for a faucet assembly 21 that is mountable on a deck 62 and having a faucet body 22. The composite body 20 has a shank 66 affixed to the deck 62 and cold and hot water supply lines 38 that are connected in the shank 66 by a support plate 102 disposed therein. The faucet body 22 is connected to the shank 66 above the deck 62. The faucet body 22 has cold and hot water openings 32 and 34 therein to be sealingly engaged by the cold and hot water supply lines 38 upon the connection of the faucet body 22 and the shank 66 for the water in the lines 38 to be mixed in the faucet 21 and discharged therefrom. Lastly, a retention ring 90 is mounted over and covers the connection of the faucet body 22 and the shank 66 to prevent accidental disengagement and to limit relative movement therebetween.

22 Claims, 7 Drawing Sheets

30
35
34
44
28
21
42
36
32
26
86
72
70
66
62
72
54
64
68
74
38
38
60
74
58

12
22
38
42
54
56
58
62
66
70
76
80
86
88
90
92
94
96
98
102
112
116
118
120
122
124
132
136
138
140
154

COMPOSITE BODY FAUCET CONNECTION

BACKGROUND OF THE INVENTION

This invention relates to a composite body faucet connection, more particularly relates to a composite body faucet connection which uses plastic components that will be mechanically connected to each other to form a leakproof, no lead or low lead connection therebetween.

In the prior art, various methods of connection were used, for example: metal component could be interconnected by soldering or brazing; plastic components could be glued together; metal or plastic components could be threadedly or mechanically interconnected. However, these methods and others were deficient in that the connecting joints had measurable lead, or were prone to leakage, or were complex, or, though easy to connect, were subject to accidental disconnection.

SUMMARY OF THE INVENTION

It is an object of the present invention to provide a composite body faucet connection which is simple in construction, economical to produce and reliable in operation.

It is another object of the present invention to provide a composite body faucet connection that is quick and easy to make, is a no lead or low lead connection and is a mechanical connection that guards against accidental disconnection.

It is another object of the present invention to provide a composite body faucet connection that can be made without tools and which can, when desired, be quickly disassembled for repairs or replacement of components.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
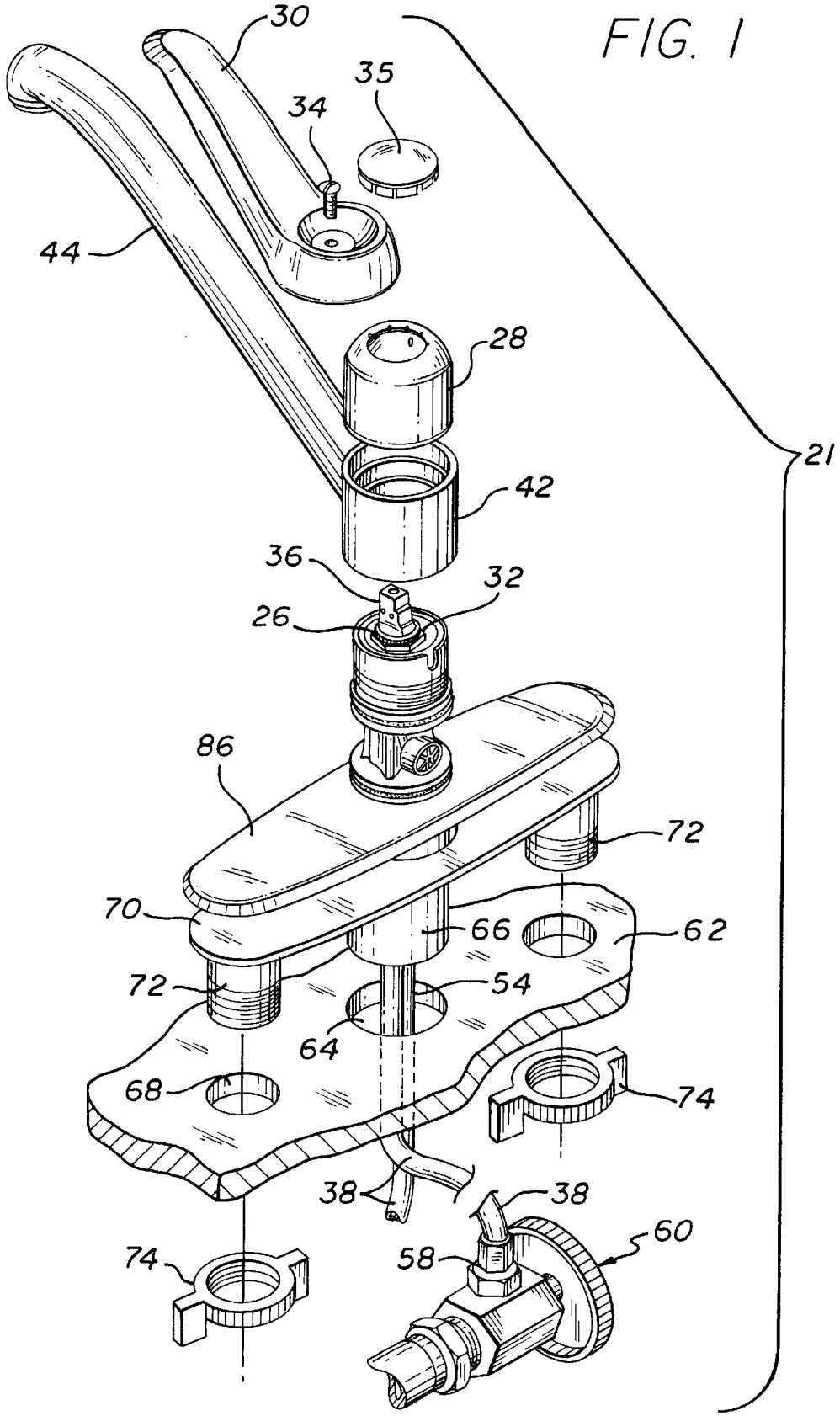
FIG. 1 is an exploded perspective view of a preferred embodiment of a kitchen type faucet assembly including the composite body of the present invention.
Figure 2:
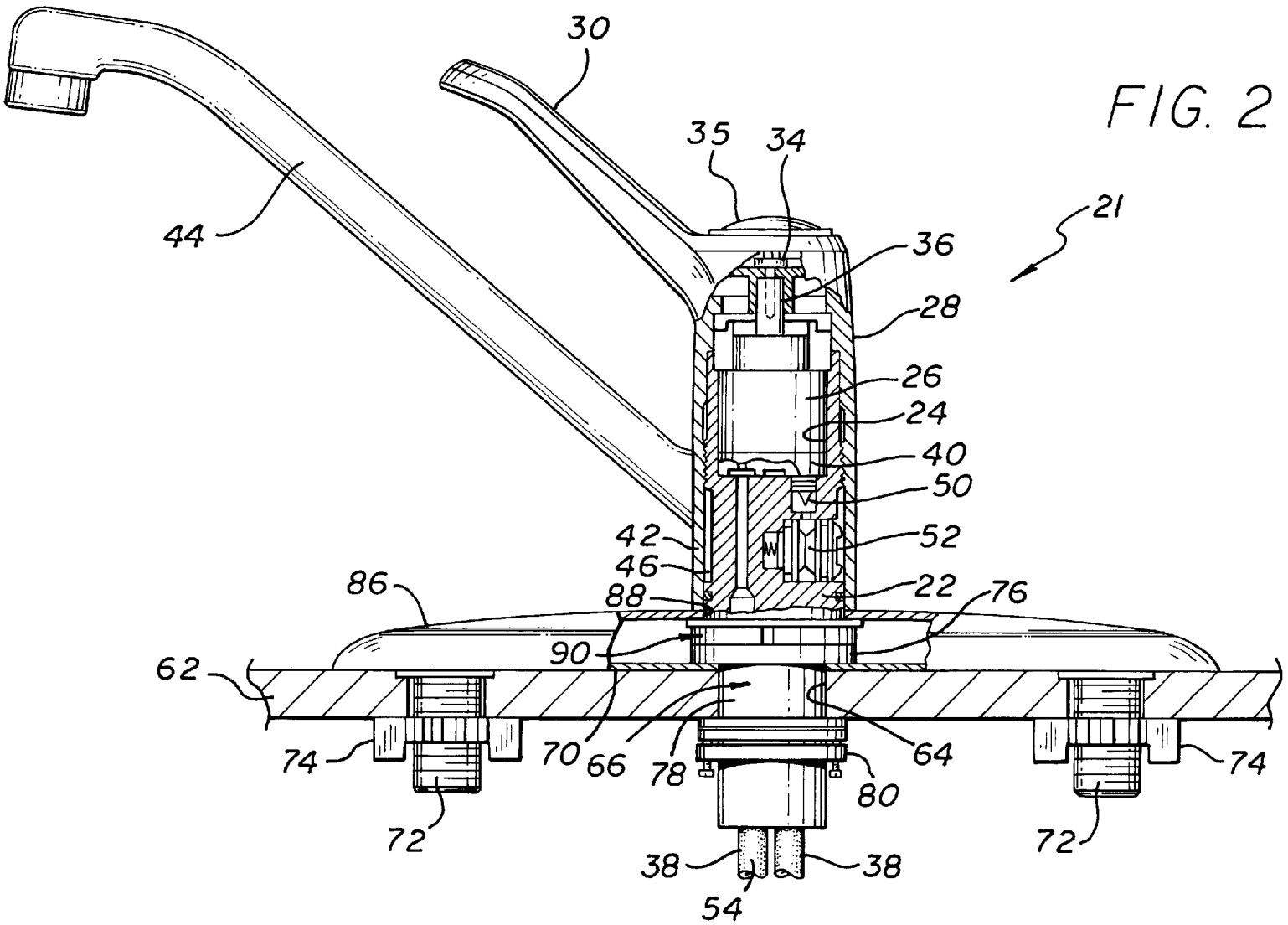
FIG. 2 is an assembled front elevational view, partly in section with the spout and handle in left profiles, of the preferred embodiment of the composite body of the present invention shown in FIG. 1.

The composite body 20 of the present invention may be formed of a suitable material, such as plastic, and is shown in FIGS. 1 and 2 as embodied in a single operator water mixing faucet assembly 21. The composite body 20 includes a casing or faucet body 22 having a hollow upper end 24 which receives a conventional ceramic-disk type cartridge 26. The lower end of the faucet body 22 is solid. An upper sleeve 28 is threaded to the faucet body 22 on the external side of the hollow upper end 24 thereof. The upper end of the upper sleeve 28 provides a seat for the operator which may take the form of a lever type control handle 30 that controls the operation of the cartridge valve 26. A retaining nut 32 is affixed to the inside of the sleeve 28 to mount the cartridge valve 26 in the faucet body 22. The control handle 30 is secured by means of a screw 34 to a lever 36 which is rotatable and shiftable up and down to control the flow of water from the cartridge valve 26 responsive to the movement of the lever handle 30. The screw 34 is enclosed by a cover 35 connected to the lever handle 30. The movement of the lever handle 30 operates to cause the valve cartridge 26 to mix incoming hot and cold water received through water supply lines or tubes 38, with the line shown on the right in FIG. 1 nominally designated for cold water and the line on the left nominally designated for hot water, but it will be understood that one of the lines 38 delivers hot water and the other of the lines 38 will deliver cold water therein. The resulting water mixture (as explained hereinafter) is directed to an outlet port 40 shown best in FIG. 2 at the top of the solid part of faucet body 22.

A lower sleeve 42 is rotatably supported on the faucet body 22 below the upper sleeve 28, and a spout 44 is mounted on the lower sleeve 42 to communicate with an annular chamber 46 located between the lower sleeve 42 and the faucet body 22. A check valve 50 is mounted adjacent to the outlet port 40 to avoid backflow in the event of a pressure loss. A non-functioning diverter valve 52 is shown in FIG. 2 as mounted in the faucet body 22 downstream of the check valve 50 for use with a sprayhead (not shown) if one were to be added. The water supply line 38 shown best in FIGS. 1, 3 and 11 has a flexible conduit 54 that extends between an upper fitting 56 and a lower fitting 58. The lower fitting 58 is connected to a conventional valve assembly 60, only one of which is shown in FIG. 1, to which the nominally designated cold water supply line is connected thereto.

The faucet assembly 21 is mounted to a deck 62 which may be a kitchen sink and is illustrated in FIGS. 1 and 2. The deck 62 has a center opening 64 in which is disposed a shank 66 having the lines 38 mounted therein, and spaced on opposite sides of the opening 64 are identical mounting holes 68. A putty plate 70 has two threaded members 72 formed thereon to pass through holes 68 for connection to the deck 62 as by nuts 74. The shank 66 has an enlarged head 76 that sits atop the deck 62 and is formed with a cylindrical body 78 that extends downwardly therethrough. A connecting member 80 disposed on the underside of the deck 62 engages the body 78 and the deck 62 to secure the shank 66 to the deck 62. A deck plate 86 is sized to cover the putty plate 70 and in assembled position, is disposed outwardly of the putty plate 70 wherein the edges of the deck plate 86 rest on the deck 62. The deck plate 86 has a predetermined height at its center with a central opening 88 therein shown best in FIGS. 2 and 11. A split retaining ring 90 shown in FIGS. 2, 11 and 12 sits atop the enlarged head 76 of the shank 66 for purposes to be explained hereinafter and has an annular external recess 92 formed at its top above an annular rim 94 to terminate at an annular vertical flange 96. In assembled position, the deck plate 86 at the opening 88 engages the recess 92 to be sandwiched between the lower end of the lower sleeve 42 and the split retaining ring 90.

Figure 3:
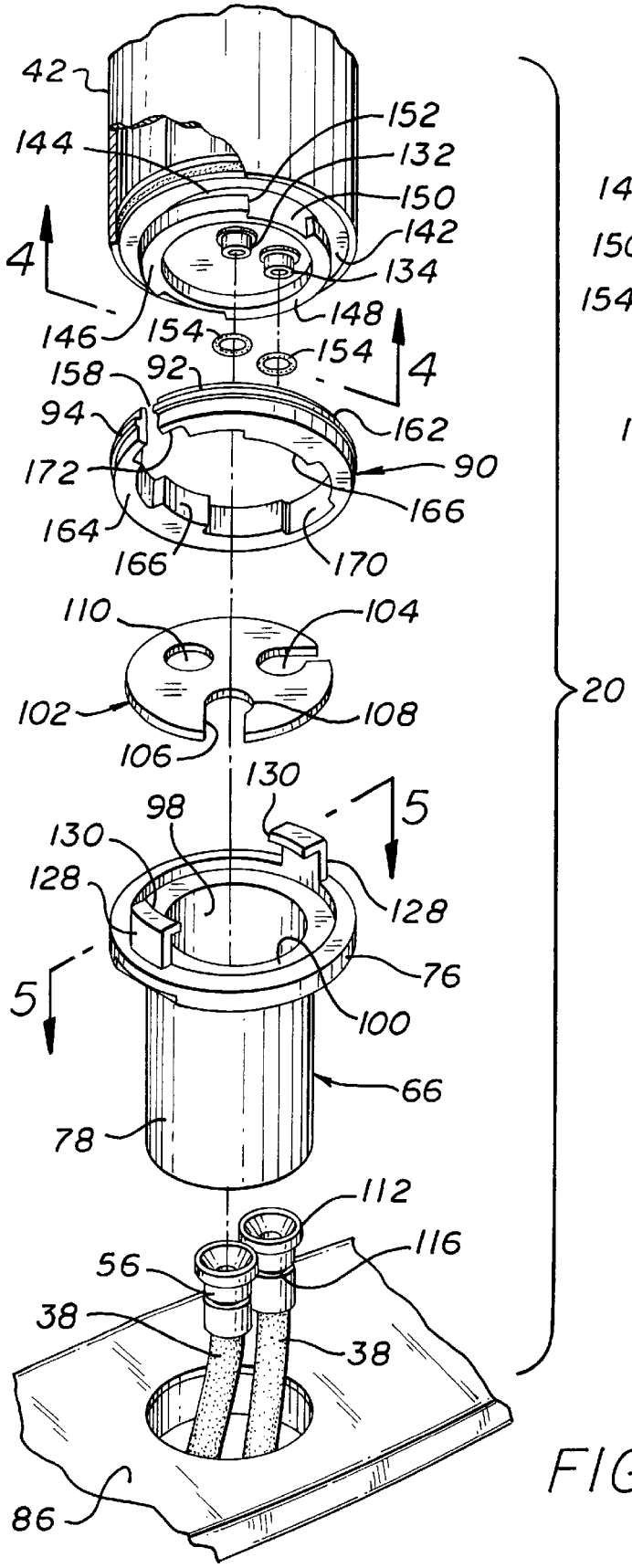
FIG. 3 is an exploded perspective view of the components of the composite body of the preferred embodiment of the present invention.

Turning now to FIG. 3 the shank 66 has a central opening 98 that runs through both the enlarged head 76 and the body 78 thereof. An annular recess 100 is formed at the top of the enlarged head 76 in communication with the opening 98. A support plate 102 having an outer diameter substantially equal to the diameter of the recess 100 is disposed in the recess 100 of the shank 66. The support plate 102 has a pair of mirror image keyhole type openings or radial slots 104. Each of the slots 104 has a small straight sided opening 106 extending radially inwardly from the outer circumference of the support plate 102 to run into a larger circular opening 108 having a larger diameter than the distance between the opposite straight sides of the opening 106. The support plate 102 may also have a diverter line opening 110 shown in FIGS. 3 and 10 which is not used in the present embodiment, but, if a diverter line (not shown) were to be added, could be.

Figure 7:
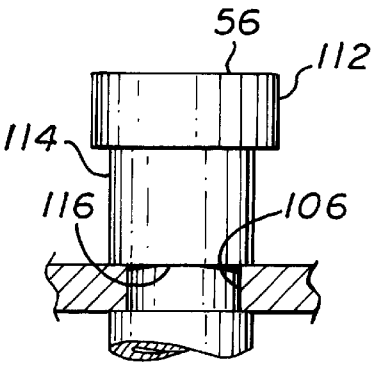
FIG. 7 is a view taken along line 7—7 of FIG. 6 showing a side elevational view of the recess of the shaft of the line in the small opening of the radial slot of the support plate.
Figure 9:
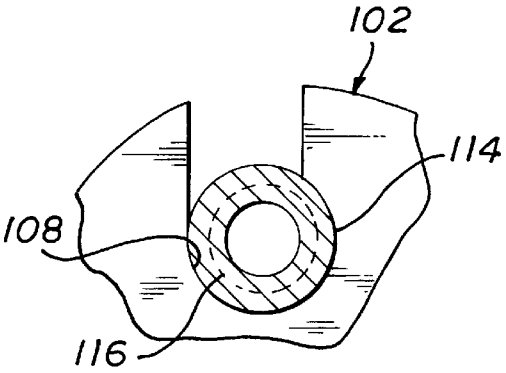
FIG. 9 is a view taken along line 9—9 of FIG. 8 showing a top plan view of the shaft of the line in the large opening of the radial slot of the support plate.
Figure 6:
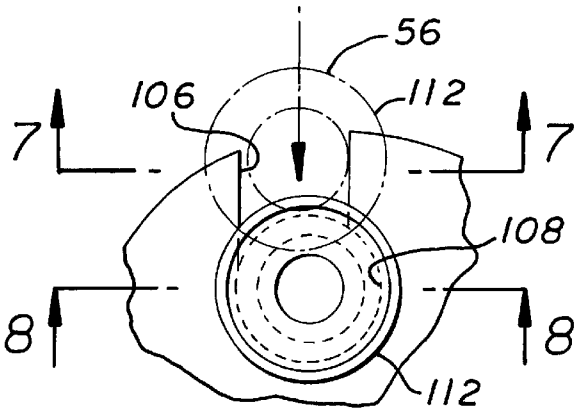
FIG. 6 is a top plan view of the connection of the water supply line to the support plate with the dotted line representation showing the recess of the shaft of the line entering the small opening of the radial slot of the support plate and the solid line representation showing the shaft of the line in the large opening of the radial slot of the support plate.
Figure 8:
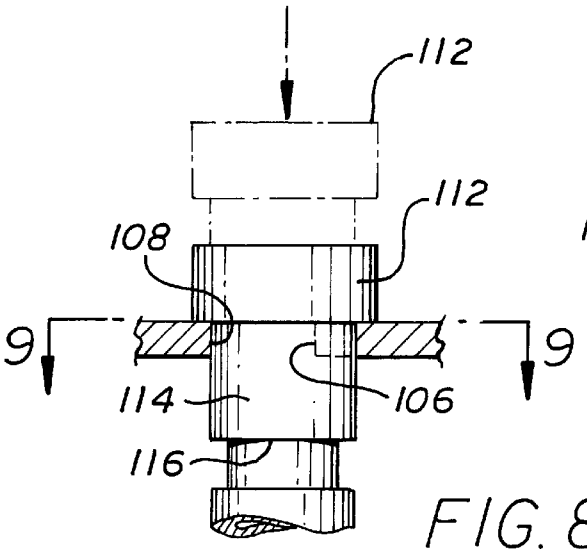
FIG. 8 is a view taken along line 8—8 of FIG. 6 showing a side elevational view of the shaft of the line in the large opening of the radial slot of the support plate.
Figures 11, 12:
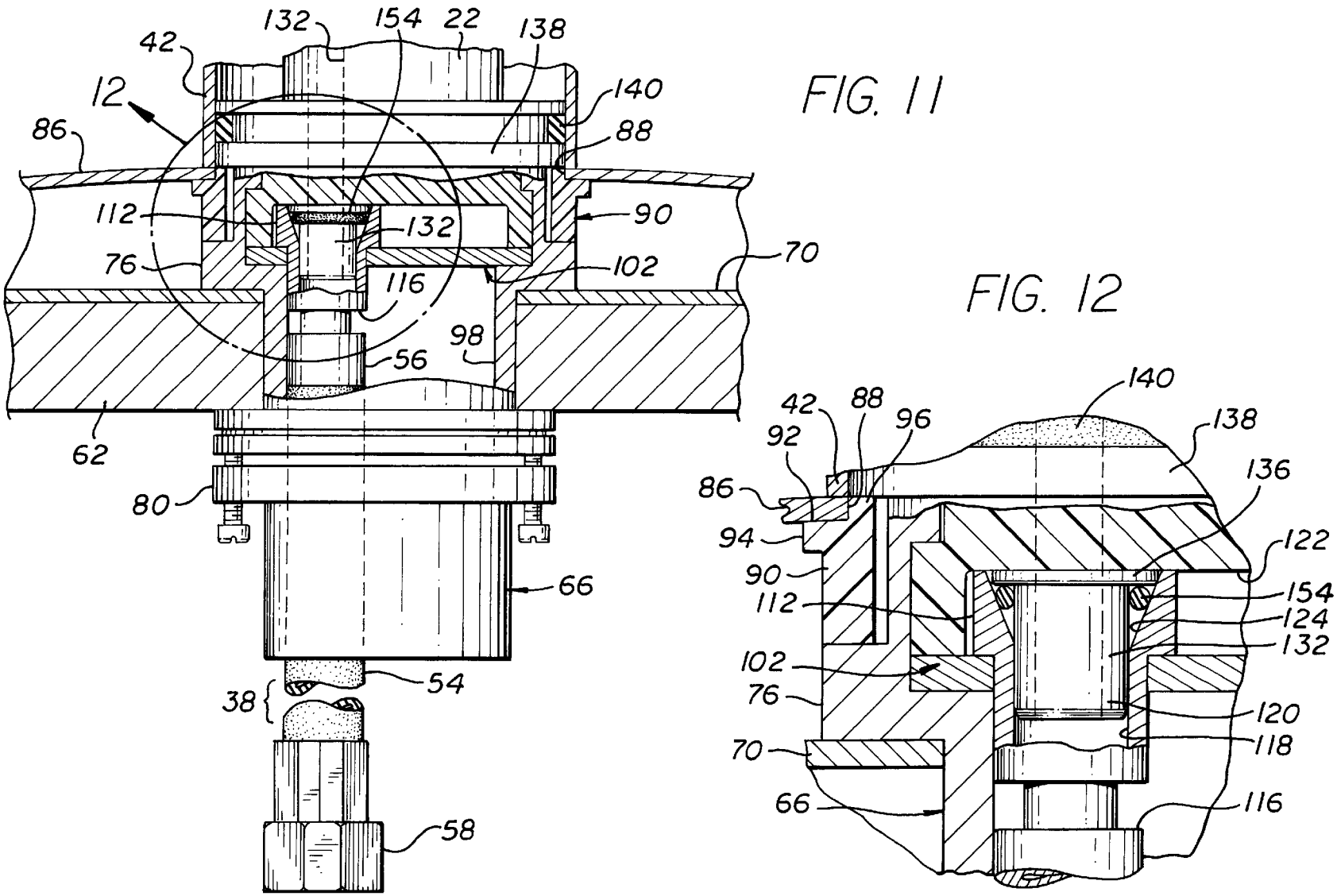
FIG. 11 is a front elevational view of the assembled composite body of the present invention, partly in section, showing the connection between the faucet body and the shank.
FIG. 12 is an enlarged view of the encircled portion of FIG. 11 showing the details of the connection between the water supply line and the receptor of the faucet body.

In order to connect the water supply lines 38 to the support plate 102 the lines 38 as best shown in FIGS. 3 and 11 will be disposed through the opening 98 of the shank 66 prior to connection to the support plate 102. Since the connection is the same for both lines 38 only one will be shown and described with reference to FIGS. 6, 7, 8 and 9. FIGS. 6 and 7 show the upper fitting 56 has an enlarged head 112 formed atop a shaft 114 having a recess 116 that reduces the diameter of the recessed portion to a size just slightly smaller than the small opening 106 to permit the shaft recess 116 of the upper fitting 56 to be inserted into the small opening 106 represented by the dotted line showing of the fitting 56 of FIG. 6 and to be slid into the large opening 108 represented by the solid line showing of the fitting 56 of FIG. 6. Once the shaft recess 11 6 has entered the larger opening represented by the dotted line showing of the fitting 56 of FIG. 8 the fitting 56 will be moved downwardly to seat the shaft 114 in the larger opening 108 which has substantially the same diameter as that of the shaft 114. In this position the enlarged head 112 sits upon the upper surface of the support plate 102 represented by the solid line showing of the fitting 56 of FIG. 8 in which position the fitting 56 is in assembled position in the support plate 102 and, because the diameter of the shaft 114 is larger than the small opening 106, it will stay in the larger opening 106, wherein it is non-removable from the slot 104 of the support plate 102. An internal opening 118 shown best in FIG. 12 is formed above the shaft recess 116 of substantially the same diameter as the outer diameter of a cylindrical receptor 120 formed integrally with the faucet body 22 and extending outwardly from the bottom 122 thereof. The upper end of the opening 118 flares outwardly to form a tapered section 124 whose taper increases upwardly to define a wide mouth opening large enough to fit an O-ring 154 between the tapered section 124 and the receptor 120 and insure a sealing engagement therebetween as described more fully hereinafter.

The shank 66 illustrated in FIGS. 2, 3, 5, 10, 11 and 12 has two diametrically opposed connecting arms 128 that extend vertically upwardly from the top of the enlarged head 76 a short distance and are formed inwardly of the outer circumference thereof adjacent to the recess 100. The upper end of the arms 128 is turned radially inwardly to form a locking tab 130 that extends substantially horizontal from each of the arms 128. The connecting arms 128 and the locking tabs 130 define inverted "L" shaped members.

Figure 4:
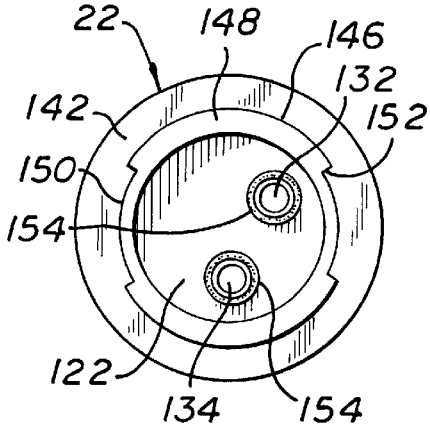
FIG. 4 is a view taken along line 4—4 of FIG. 3 showing a plan view looking upwardly into the bottom of the faucet body.
Figure 5:
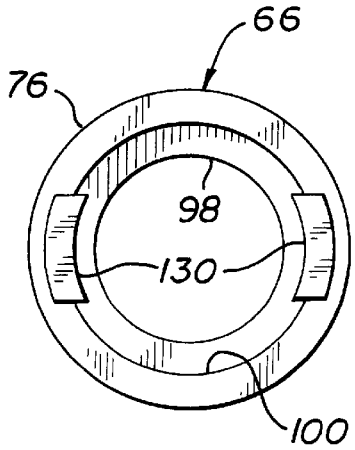
FIG. 5 is a view taken along line 5—5 of FIG. 3 showing a plan view looking downwardly into the top of the shank.

As explained above, the valve cartridge 26 is received the hollow upper end 24 (FIG. 2) of the faucet body 22. The water supply lines 38 pass water through the faucet body 22 through inlets 132 and 134, respectively, as shown in FIGS. 3 and 4. Since the structure is the same for both inlets 132 and 134, for convenience, only inlet 132 will be referred to and is illustrated as in FIGS. 2, 11 and 12. The inlet 132 best shown in FIGS. 10, 11 and 12 extends from the cylindrical receptor 120 upwardly through the faucet body 22 to deliver the water to the valve cartridge 26. At the bottom 122 of the faucet body 22, an annular ring 136 is formed about the receptor 120 for purposes more fully explained hereinafter. The lower section 138 of the faucet body 22 below the annular chamber 46 is sealed by O-ring 140 best shown in FIGS. 3, 11 and 12 on the bottom end of which is an annular platform 142. The platform 142 serves as an underside of a shallow groove or circumferential recess 144 the upper side of which is formed by a circular ledge 146 disposed inwardly of the outer circumference of the platform 142 and having a horizontal end 148. The inner wall 150 (FIG. 3) of the recess 144 is circular and extends to the end 148 at two diametrically opposed sites to define circumferential openings or mating grooves 152 that communicate with the recess 144 and serve to divide the ledge 146 into two portions, each of which extend radially outwardly from the wall 150 and have circular outer circumferences that extend a short distance over the annular platform 142 on the upper side of the recess 144. The inside of the wall 150 adjacent the end 148 limits the boundary of the bottom 122 of the faucet body 22. A pair of O-rings 154 are sized to be slidingly engaged on the receptors 120 for purposes more fully explained hereinafter.

The split retaining ring 90 illustrated in FIGS. 2, 3, 10, 11, 12, 13 and 14 has a diameter substantially equal to the diameter of the faucet body 22 on which it will be engaged. The rim 94 extends outwardly from the outer circumference of the ring 90 interrupted only by the split opening 158 therein. The recess 92 is formed on the side of the rim 94 facing the body 22 in which the deck plate 86 is mounted (FIGS. 11 and 12) between the sleeve 42 and the ring 90. The retaining ring 90 has a flat surface 162 that engages the platform 142, and a flat surface 164 that engages the top of the enlarged head 76 of the shank 66, each in the assembled position shown in FIGS. 11 and 12. The ring 90 has a large substantially open inside in which a pair of diametrically opposed detents 166 extend. The detents 166 each have circular inner surfaces of substantially equal curvature as that of the corresponding circular outer circumferences of the ledges 146.

Figure 14:
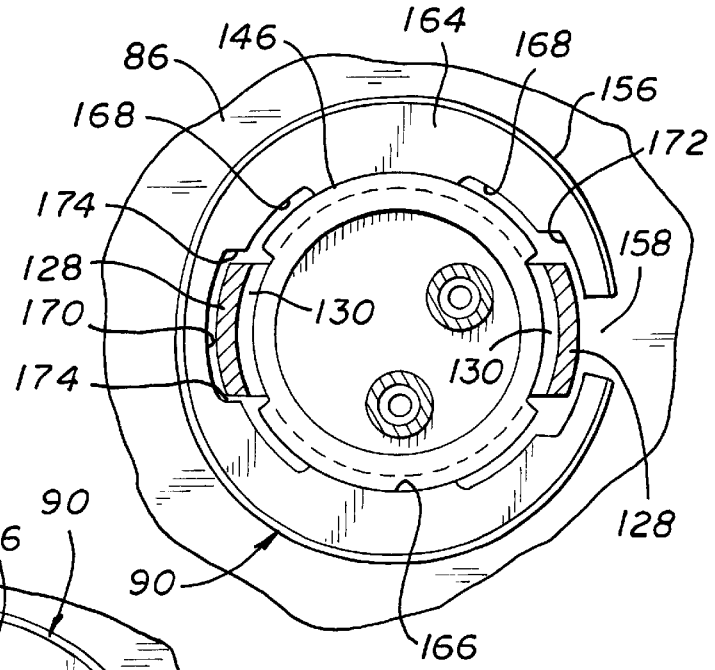
FIG. 14 is a view taken along line 14—14 of FIG. 13 showing a plan view looking upwardly into the bottom of the faucet body with the retaining ring disposed on the faucet body and the connecting arms of the shank disposed in the mating grooves of the faucet body, but not yet locked in assembled position.

Adjacent the detents 166 and having a greater radius measured from the center of the ring 90 than that of the detents 166 are a pair of diametrically opposed recesses 168 at the center of each is a second deeper pair of diametrical recess 170 and 172 best shown in FIGS. 3 and 14 with the recess 172 being formed at the split opening 158 of equal radius but slightly wider than the recess 170 which is formed opposite thereof. The recess 170 has opposed edges 174 which terminate in the recesses 168. The radius of the edges 174 will overlap the radius of connecting arms 128 to cause abutting contact therebetween for purposes more fully explained hereinafter.

Figure 13:
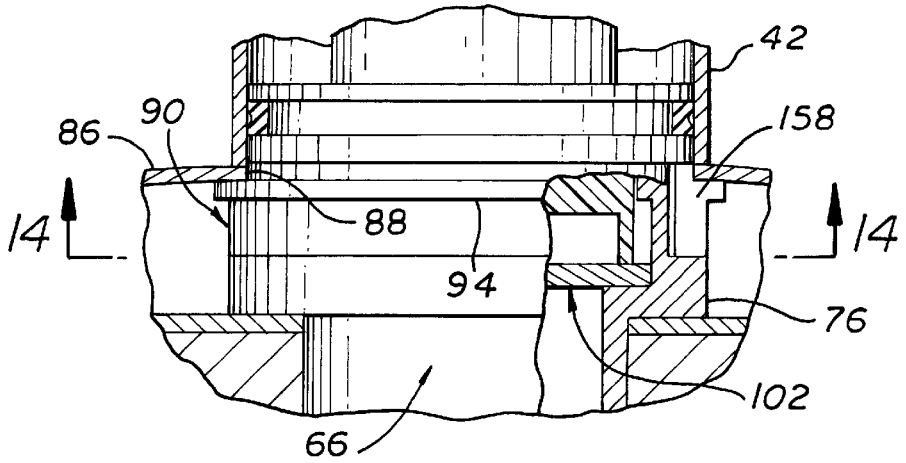
FIG. 13 is a front elevational view of the assembled composite body of the present invention, partly in section, illustrating the first position of the connection between the faucet body and the shank.

In order to assemble the composite body 20 the faucet body 22 and the shank 66 will be relatively rotated to align the connecting arms 128 of the shank 66 with the mating grooves 152 of the faucet body 22. Also aligned are the water supply lines 138 with the receptors 120. The support plate 102 which carries the water supply lines 138 rotatably sits in the recess 100 and will be rotated to enable the required alignment to be made since the spacing between the respective lines 138 and receptors 120 is preset to be equal. Placing the connecting arms 128 into the mating grooves 152 as shown in FIGS. 13 and 14 serves the dual function of positioning the locking tabs 130 adjacent the recesses 144, and connecting the lines 38 in the receptors 1 20 as best shown in FIGS. 11 and 12. Upon placing the lines 38 in the receptors 120 the support plate engages the end 148 of the ledge 146, and the enlarged head 112 engages the bottom 122 of the faucet body 22 with the upper end of the tapered section 124 providing room for the annular ring 136 that engages to squeeze to O-ring 126 between the receptor 120 and the tapered section 124 to both seal and resiliently connect the line 38 and the receptor 120. Also, relative rotation between the faucet body 22 and the shank 66 does not disturb the connection of the line 38 and the receptor 120 since the support plate 102 is free to hold its position during relative rotation of the faucet body 22 and the shank 66.

Figure 10:
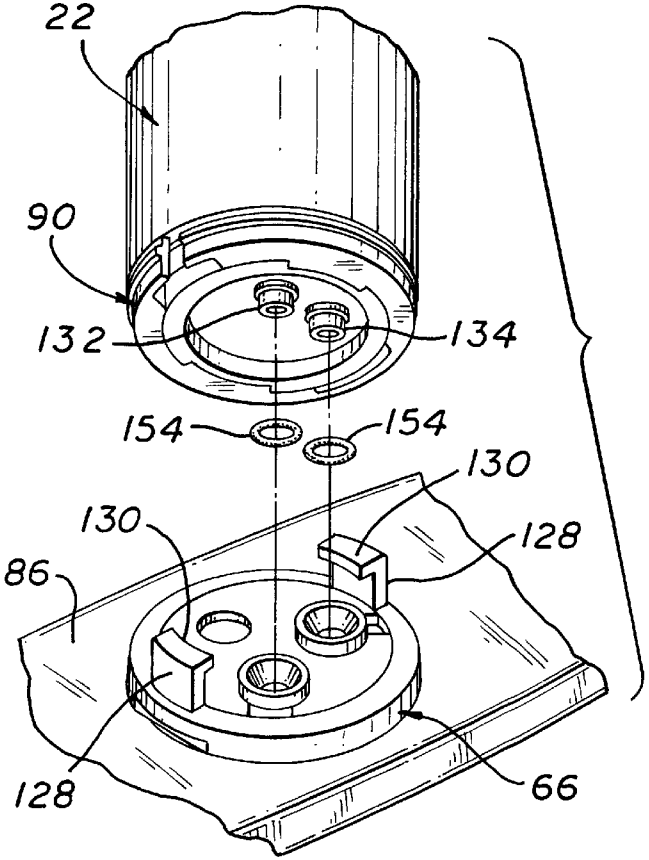
FIG. 10 is an exploded perspective view of the shank mounted in the deck with the water supply lines disposed therein and aligned with the receptors of the faucet body, and the retaining ring mounted in the faucet body which is unconnected to the shank.
Figure 15:
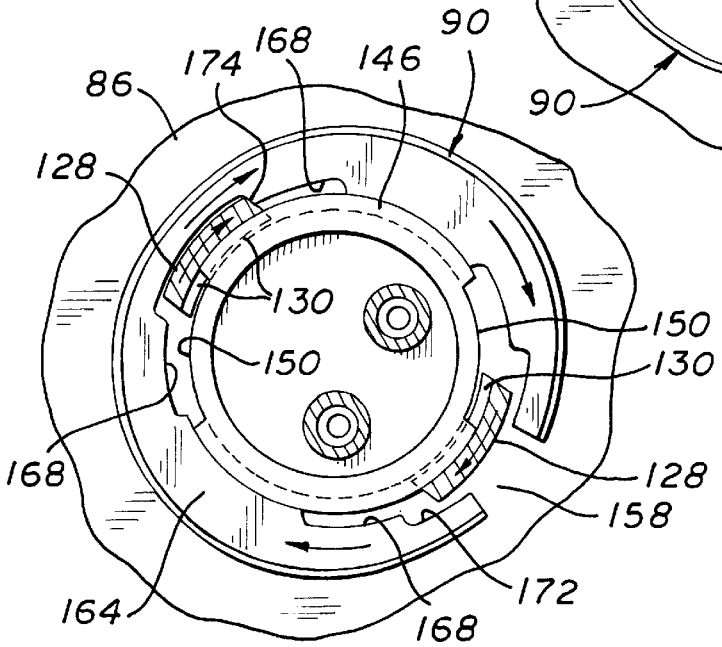
FIG. 15 is a view similar to FIG. 14 except that the shank and the retaining ring have been rotated clockwise to an intermediate position showing the locking tabs of the shank partly disposed in the recess of the faucet body.
Figure 16:
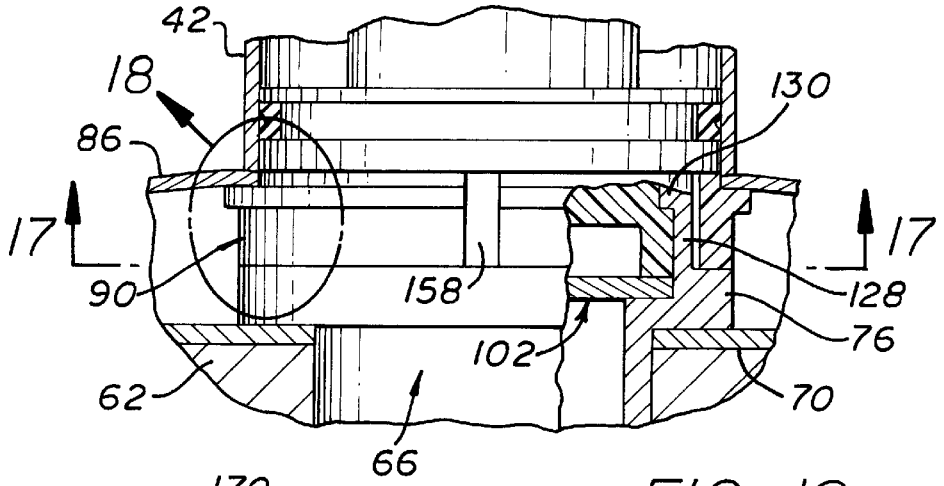
FIG. 16 is a front elevational view of the assembled composite body of the present invention, partly in section, showing the locking tab of the shank fully disposed in the recess of the faucet body.
Figure 17:
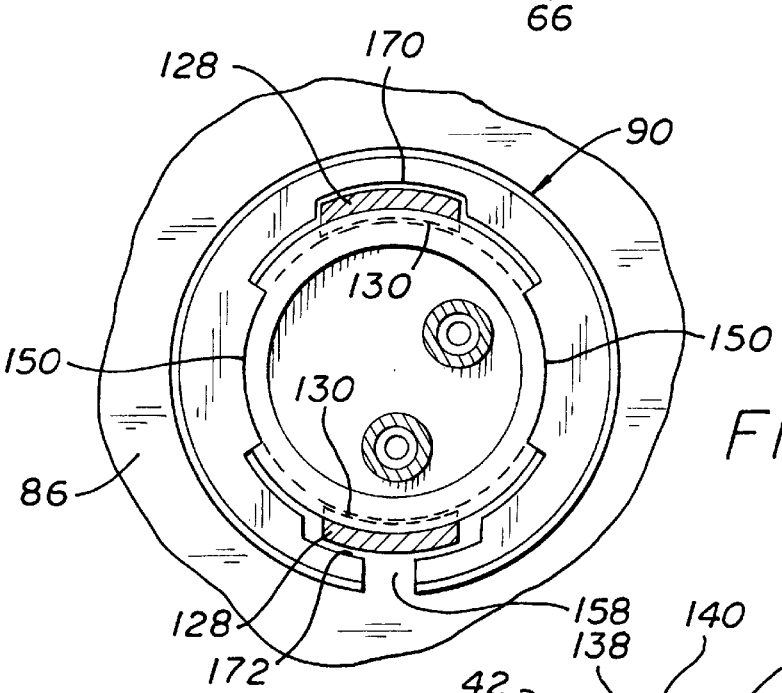
FIG. 17 is a view taken along line 17—17 of FIG. 16 showing the assembled position of the composite body of the present invention with the locking tabs of the shank fully disposed in the recess of the faucet body and the retaining ring engaged with the faucet body and covering the connecting arms of the shank.
Figure 18:
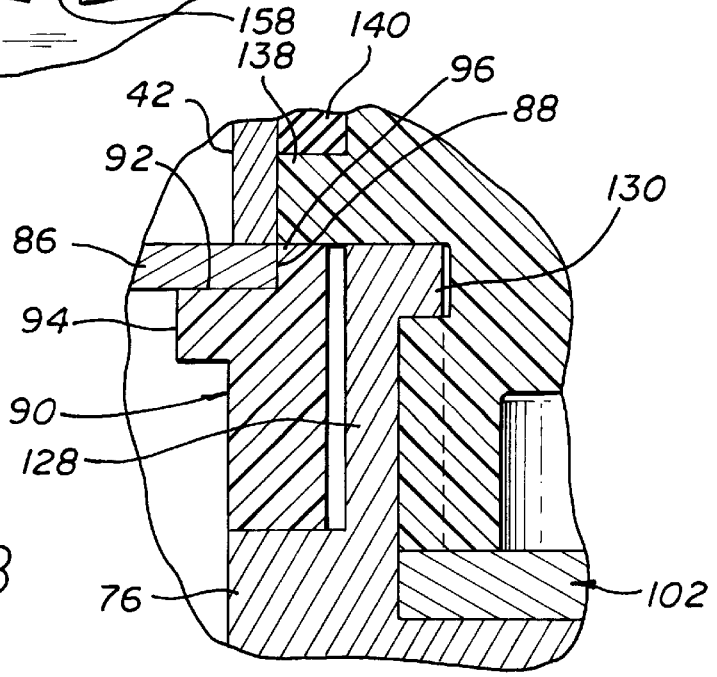
FIG. 18 is an enlarged sectional view taken of the encircled portion of FIG. 16 showing the details of the final assembled position of the composite body of the present invention with the locking tabs of the shank fully disposed in the recess of the faucet body and the retaining ring covering the connecting arm of the shank.

For ease of assembly, the split retaining ring 90 as shown in FIGS. 10 and 14 will be mounted on the lower section 138 of the faucet body 22 by mounting the detents 166 on the ledges 146. Because the outer diameter of the ledges 146 is slightly larger than diameter between the opposing detents 166 the split opening 158 will be slightly expanded, but this is a temporary change as the ring 90 is resilient. Insertion of the connecting arms 128 of the shank 66 into the mating grooves 152 of the faucet body 22 shown in FIGS. 13 and 14 illustrates a first position in the assembly of the composite body 20. An intermediate position is illustrated in FIG. 15 wherein the solid line arrows on both the retention ring 90 and the connecting arms 128 of the shank 66 indicate clockwise rotation of these components. It will be understood that other components could have been rotated to assemble the composite body 20 and the rotation could have been counter clockwise rather than clockwise, but in the present instance this description of the assembly will suffice. Accordingly, clockwise rotation of the shank 66 will shift the connecting arms 128 into engagement with the edge 174 of the recess 170 to force a likewise clockwise movement of the retention ring 90 by shifting the detent 166 on the ledge 146, while placing the locking tabs 130 partially within the circumferential recess 144 as shown in FIG. 15. Continued clockwise rotation of the shank 66 will the place the connecting arms 128 in the 6 and 12 o'clock positions shown in FIG. 17 wherein the detents 166 of the retaining ring 90 will snap into the mating grooves 152 upon reaching the 3 and 9 o'clock positions. In this position the retaining ring 90 is restored to its unexpanded position and the opening 158 returns to its normal (smaller) size, as best shown in FIG. 17. The detents 166 of the retention ring 90 are close fitting in the mating grooves 152, and the ledges 146 of the faucet body 22 will be disposed in the recesses 168 wherein a small radial distance exists therebetween. Also, the connecting arms 128 are disposed in the recesses 170 and 172 with a similar small radial distance therebetween, but the retention ring 90 acts to cover the connecting arms 128 to prevent accidental removal of the locking tabs 130 from their engagement within the recess 144.

It will be seen that the assembly of the composite body 20 is completed by the simple mechanical connection of the components, without the need of tools, as by insertion and the twist to lock movement between the faucet body 22 and the shank 66, with the retention ring 90 covering the connection and limiting relative movement therebetween to insure against accidental disconnection thereof. Such a connection is no or low lead, low cost and promotes easy installation and reparability. As noted earlier, the material of the components of the composite body 20 can be made of any suitable plastic.

It will be appreciated that while a particular embodiment of the invention has been shown and described, modifications may be made. The appended claims are intended to cover all such modifications which come within the true spirit and scope of the invention.

What is claimed is:

1. A composite body for a faucet assembly mounted on a deck, the composite body assembly comprising:

a. a faucet body mounted from above onto the deck;

b. a shank having an upper portion disposed above the deck and a lower portion disposed below the deck and the shank being affixed to the deck;

c. at least one water supply line connected to the shank;

d. the faucet body connected to the shank;

e. the faucet body having at least one opening therein for water to be received in and discharged from the faucet;

f. the opening to be sealingly engaged by the supply line upon the connection of the faucet body and the shank; and g. a retention ring interconnected between the faucet body and the shank above the deck to cover the connection therebetween and substantially to prevent relative movement therebetween.

2. The combination claimed in claim 1 wherein:

a. the water supply line in the shank includes a cold water supply line and a hot water supply line;

b. each of the supply lines having a enlarged head;

c. a support plate;

d. a plurality of radial slots formed in the support plate of a smaller width than the diameter of the enlarged heads of the supply lines;

e. each of the supply lines disposed in one of the slots, with the enlarged heads thereof disposed above the support plate to prevent the supply lines from being removed downwardly from the slots;

f. the support plate removeably mounted in the upper portion of the shank; and g. the faucet body having a cold water opening and a hot water opening, each to be sealingly engaged by the enlarged head of the respective cold and hot water lines upon the connection of the faucet body and the shank.

3. The combination claimed in claim 2 wherein each of the slots receiving the water lines are formed with a keyhole type opening.

4. The combination claimed in claim 3 wherein the larger opening of the keyhole type opening is disposed radially inwardly of the smaller opening thereof.

5. The combination claimed in claim 4 wherein the slots of the support plate extend radially inwardly from the circumference thereof.

6. The combination claimed in claim 5 wherein:

a. each of the supply lines having a shaft formed below the enlarged heads thereof of reduced diameter;

b. a recess formed on each of the shafts in spaced relation to and below the enlarged heads thereof; and c. the diameter of the recess substantially equal to the small opening of the keyhole type opening, and the diameter of the shaft substantially equal to the large opening of the keyhole type opening whereby each of the supply lines are connected to the support plate by passing the recess from the small opening to the large opening and shifting the shaft downwardly to engage the enlarged head with the support plate.

7. The combination claimed in claim 6 wherein:

a. the enlarged head of each of the supply lines having an internal opening tapered to upwardly increase in diameter; and b. an "O"-ring disposed in each of the internal openings substantially to seal the connection between the faucet body and the shank at the openings therein.

8. The combination claimed in claim 2 wherein:

a. at least one locking tab formed on the shank; and b. a circumferencial recess formed on the faucet body and to receive the locking tab therein upon the connection of the faucet body and the shank.

9. The combination claimed in claim 8 wherein:

a. a pair of connecting arms formed on and extending outwardly of the shank, each having a locking tab formed thereon; and b. a pair of circumferencial openings formed in the faucet body in communication with the recess therein and to receive the axially aligned connecting arms of the shank to be inserted therein and rotated to place the locking tabs into locking engagement in the recess thereof.

10. The combination claimed in claim 9 wherein:

a. the retention ring being split;

b. detent means formed on the inner circumference of the retention ring; and c. mating grooves shaped corresponding to the detent means formed on the outer circumference of the faucet body whereby on rotation of the retention ring the detent means thereof to be disposed in the mating grooves of the faucet body with the retention ring engaging the arms normally to prevent removal of the locking tabs from the recess.

11. The combination claimed in claim 10 wherein the connecting arms extend through the mating grooves prior to disposing the locking tabs in the recess upon relative rotation of the shank and the faucet body.

12. The combination claimed in claim 11 wherein:

a. a pair of ledges formed adjacent the mating grooves on one side of the recess; and b. the locking tabs engaging the ledges to prevent disconnection between the shank and the faucet body.

13. The combination claimed in claim 12 wherein:

a. a platform is formed on the faucet body on the side of the recess opposite the ledges;

b. the retaining ring having a pair of arm recesses disposable radially outwardly of the mating grooves to permit the connecting arms to be inserted into the mating grooves and the platform to limit the axial insertion thereof;

c. the arm recesses circumferentially spaced from the detents;

d. the detents formed on opposite sides of the retention ring and to engage the faucet body; and e. the distance between detents slightly smaller than the distance between the outer circumference of the faucet body whereby the diameter of the retention ring is slightly expanded and placed in tension and on relative rotation of the shank the retention ring to spring back to its normal diameter and the detents to snap into the mating grooves and the locking tabs to lockingly enter the recess of the faucet body.

14. A composite member for a faucet assembly mountable on a deck, the composite member comprising:

a. a first body mounted on the upper surface of the deck;

b. a second body affixed to the deck and to extend above and below the deck;

c. at least one water supply line connected in the second body;

d. the first body connected above the deck to the second body;

e. the first body having at least one opening therein for water to be received and discharged from the faucet;

f. the opening in the first body to be sealingly engaged by the supply line upon the connection of the first body and the second body; and g. a retention ring interconnected between the first body and the second body above the deck to cover the connection therebetween and substantially to prevent relative movement therebetween.

15. The combination claimed in claim 14 wherein:

a. the water supply line in the second body includes a cold water supply line and a hot water supply line;

b. each of the supply lines having an enlarged head;

c. a support plate;

d. a plurality of radial slots formed in the support plate of a smaller width than the diameter of the enlarged heads of the supply lines;

e. each of the supply lines disposed in one of the slots, with the enlarged heads thereof disposed above the support plate to prevent the supply lines from being removed downwardly from the slots;

f. the support plate removeably mounted in the second body; and g. the first body having a cold water opening and a hot water opening, each to be sealingly engaged by the enlarged head of the respective cold and hot water lines upon the connection of the first body and the second body.

16. The combination claimed in claim 15 wherein each of the slots receiving the water lines are formed with a keyhole type opening.

17. The combination claimed in claim 16 wherein the larger opening of the keyhole type opening is disposed radially outwardly of the smaller opening thereof.

18. The combination claimed in claim 17 wherein the slots of the support plate extend radially inwardly from the circumference thereof.

19. The combination claimed in claim 18 wherein:

a. at least one locking tab formed on the second body; and b. a circumferencial recess formed on the first body and to receive the locking tab therein upon the connection of the first body and the second body.

20. The combination claimed in claim 19 wherein:

a. a pair of connecting arms formed on and extending outwardly of the second body, each having a locking tab formed thereon; and b. a pair of circumferencial openings formed in the first body in communication with the recess therein and to receive the axially aligned connecting arms of the second body to be inserted therein and rotated into locking engagement in the recess of the first body.

21. The combination claimed in claim 20 wherein:

a. the retention ring being split;

b. detent means formed on the inner circumference of the retention ring; and c. mating grooves to the detent means formed on the outer circumference of the first body whereby on rotation of the retention ring the detent means thereof to be disposed in the mating grooves of the first body with the retention ring engaging the arms normally to prevent removal of the locking tabs from the recess.

22. The combination claimed in claim 14 wherein:

a. the first body having an annular platform of predetermined diameter formed thereon inwardly of an end facing the second body;

b. a cylindrical projection of smaller diameter than the platform extending from the platform to the said end;

c. a pair of arcuate ledges formed at the said end to extend radially outwardly over the platform in spaced relationship therewith and to form a recess therebetween;

d. a pair of grooves formed on the cylindrical projection adjacent ledges and in communication with the recess;

e. the second body having an end facing the first body and having a pair of axially extending arms therefrom formed radially outwardly of the ledges;

f. a pair of locking tabs formed on the second body at the end of the arms to extend radially inwardly therefrom;

g. the locking tabs are disposable in the grooves of the first body to enter the recess;

h. the retention ring is split and expandable and has a pair of opposed detents formed thereon at a distance therebetween that is slightly smaller than the external distance between the arcuate ledges whereby upon the detents engaging the ledges, the retention ring to slightly expand in diameter and be placed in tension;

i. a pair of arm openings formed radially outwardly of and opposite the detents, with one of the openings adjacent the split; and j. the locking tabs disposed in the recess to lockingly engage the ledges upon relative rotation of the first body and the second body whereby the retention ring to spring back to its unexpanded diameter upon the detents to snap into the grooves and the retention ring will cover the arms to prevent accidental disassembly of the first and second bodies.

* * * * *